United States Patent [19]

Beede

[11] Patent Number: 4,569,500

[45] Date of Patent: Feb. 11, 1986

[54] CONCRETE RAMP FORM

[76] Inventor: Earl R. Beede, Rte. 3A, Bow, N.H. 03301

[21] Appl. No.: 410,084

[22] Filed: Aug. 20, 1982

[51] Int. Cl.[4] ..... B28B 7/22

[52] U.S. Cl. ..... 249/123; 52/174; 249/13; 249/63; 249/131; 249/180; 249/185

[58] Field of Search ..... 249/1, 4, 6, 13, 63, 249/162, 170, 172, 184, 185, 14, 122, 123, 129, 131, 180; 52/174; 264/333

[56] References Cited

U.S. PATENT DOCUMENTS

| | | | |
|---|---|---|---|
| 2,281,698 | 5/1942 | Kogl | 249/14 |
| 2,331,701 | 10/1943 | Kogl | 249/14 |
| 2,702,931 | 3/1955 | Johnson | 249/14 |
| 2,809,414 | 10/1957 | Mitchell | 249/2 |
| 3,269,688 | 8/1966 | Hulicki | 249/185 |
| 3,284,042 | 11/1966 | Ingalise | 249/14 |
| 3,310,275 | 3/1967 | Lyons | 249/14 |
| 3,539,146 | 11/1970 | Smith | 249/63 |
| 3,558,095 | 1/1971 | McNiel | 249/13 |
| 3,582,035 | 6/1971 | Wells et al. | 249/18 |
| 3,780,976 | 12/1973 | Messier | 249/63 |

FOREIGN PATENT DOCUMENTS

| | | | |
|---|---|---|---|
| 0757320 | 8/1980 | U.S.S.R. | 249/13 |

*Primary Examiner*—Willard E. Hoag
*Assistant Examiner*—James C. Housel

[57] ABSTRACT

A concrete ramp is, in cross section, in the form of an inverted U and is made in sections. The form includes a base the upper surfaces of which are inclined relative to the horizontal at an angle wanted for tread surface of the ramp. A pair of inner and outer side walls are provided for each side of the base and then are shaped and dimensioned so that their upper edges are horizontal, the height of the inner walls less than that of the outer walls. The walls of each pair are hingedly connected to the base in a manner enabling the outer walls to swing outwardly and the inner walls to swing inwardly. Power operated devices supported by the base are operable to hold the inner walls vertically or to pull them inwardly. A plate is supported by the inner walls in a manner permitting it to be lowered or raised as the inner walls are swung into or out of their operative position. The plate is flat except at the front end where it is formed to establish a thickened front portion of the ramp, the upper surface of which is coplanar with the remainder of the ramp and the bottom surface of which is horizontal.

7 Claims, 11 Drawing Figures

Fig. 1
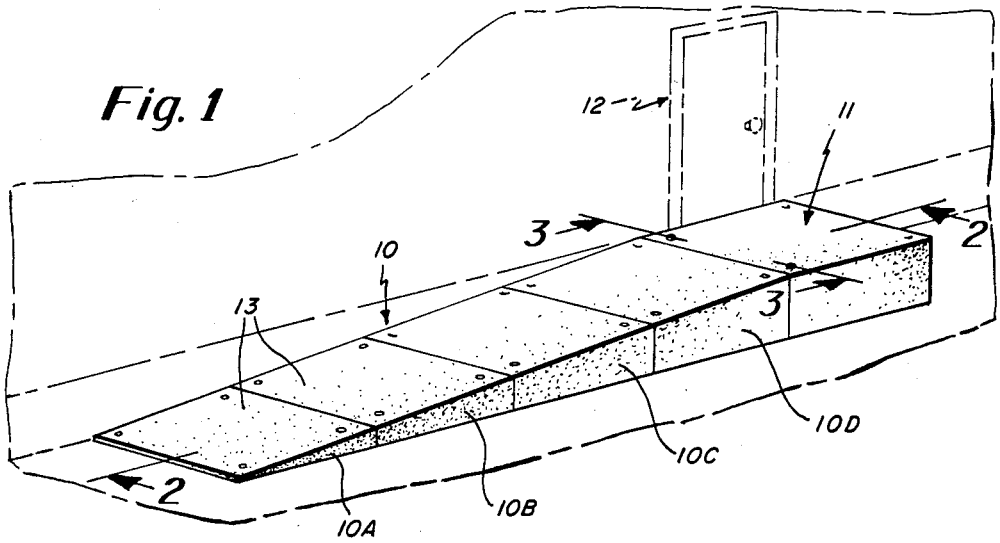
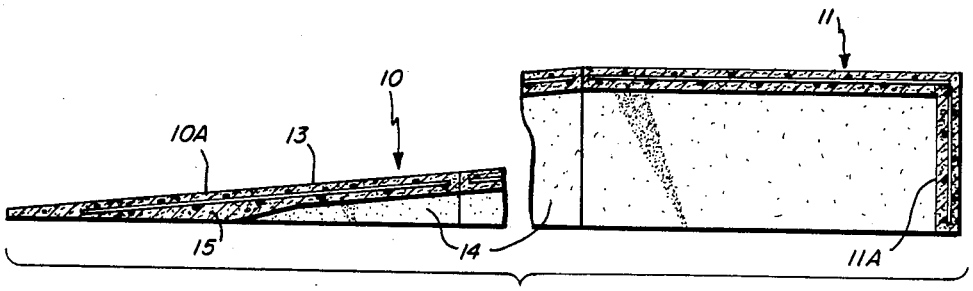
Fig. 2
Fig. 3
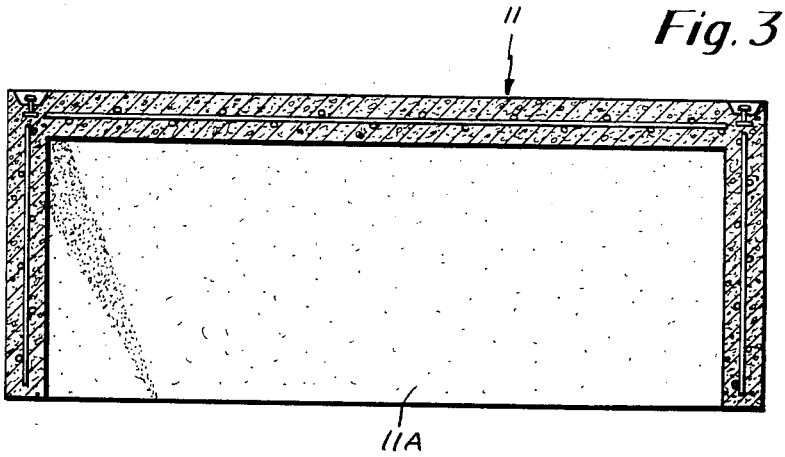

CONCRETE RAMP FORM

BACKGROUND OF THE INVENTION

For those confined to wheel chairs and for those to whom climbing steps is a real difficulty, ramps are necessary.

While ramps are built where needed, there are, as far as I am aware, no preformed concrete ramps or concrete ramps that can be preformed to wanted dimensions, transported to the site where needed and quickly and easily installed.

THE PRESENT INVENTION

The general objective of the present invention is to provide preformed concrete ramps and a form for use in their production with the ramps meeting construction, transportation and use requirements.

In accordance with the invention, this objective is attained with ramps formed in sections, each section of reinforced concrete and U-shaped in cross section providing a deck and sides with the bottom edges of the sides transversely aligned and in a plane inclined relative to the plane of the deck to provide the wanted ramp slope. The bottom or first section has a ground level, transverse end portion that is integral with the deck and side walls and provides adequate strength where otherwise that end of that section would be relatively easily damaged.

A second major objective of the invention is the provision of a form enabling such a sectional ramp to be made. This objective is attained with a form having a base that is inclined in a manner wanted for the incline of the deck of the ramp with the high end of the base, its front end. Pairs of inner and outer walls are hingedly connected to the base to swing, respectively, inwardly and outwardly. The inner walls are under the control of power operated devices operable to erect the inner walls to hold them erect and swing them inwardly when the form is to be collapsed. The upper edges of the walls are horizontal when erected and those of the inner walls are spaced below the corresponding edges of the outer walls by a distance equal to the wanted thickness of the deck. Shoulders on the inner surfaces of the inner walls hold a deck-forming plate flush with their upper edges, the plate so supported that it rests on the upper edges when the inner walls are swung inwardly to a predetermined maximum extent. A series of transverse, detachable clamping units hold the outer walls erect.

The front ends of the inner walls terminate short of the outer walls and the plate includes a main portion which is coextensive in length with the inner walls, a forward portion supported by the base and flush with its upper surfaces, and an intermediate, forwardly and downwardly inclined portion joining the main and forward plate portion. The forward portion carries a transverse cut-off butting the forward edges of the outer side walls.

Sections are formed by the use of U-shaped cut-offs each of the transverse dimensions of the concrete receiving cavity of the form at a particular location lengthwise of the form and these are held in position between pairs of holders on the base. At the lengths of the sections wanted for a particular installation may be different from those required for another ramp, the holders are tack welded in place enabling the form to be easily adapted for wanted section lengths. Other objectives of the invention and the manner of their attainment will be apparent from the accompanying drawings, the specification and the appended claims.

PRIOR ART STATEMENT

The only prior art known to applicant relevant to the claimed subject matter are the previously listed patents.

Of these, U.S. Pat. No. 3,582,035 disclosed a concrete pan forming system in which panels were held on a base provided with clips and brackets with the brackets serving to hold a top panel.

U.S. Pat. No. 2,809,414 disclosed a form which utilized side members interconnected by transverse members which bridged the concrete-receiving area.

BRIEF DESCRIPTION OF THE DRAWINGS

The accompanying drawings illustrate a preferred embodiment of the invention of which FIG. 1 is a perspective view of a ramp and platform in accordance with the invention;

FIG. 2 is a fragmentary view of the ramp and platform, taken on an increase in scale substantially along the indicated line 2—2 of FIG. 1;

FIG. 3 is a section on a further increase in scale, taken approximately along the indicated line 3—3 of FIG. 1;

THE PREFERRED EMBODIMENT OF THE INVENTION

Figures 4, 5:
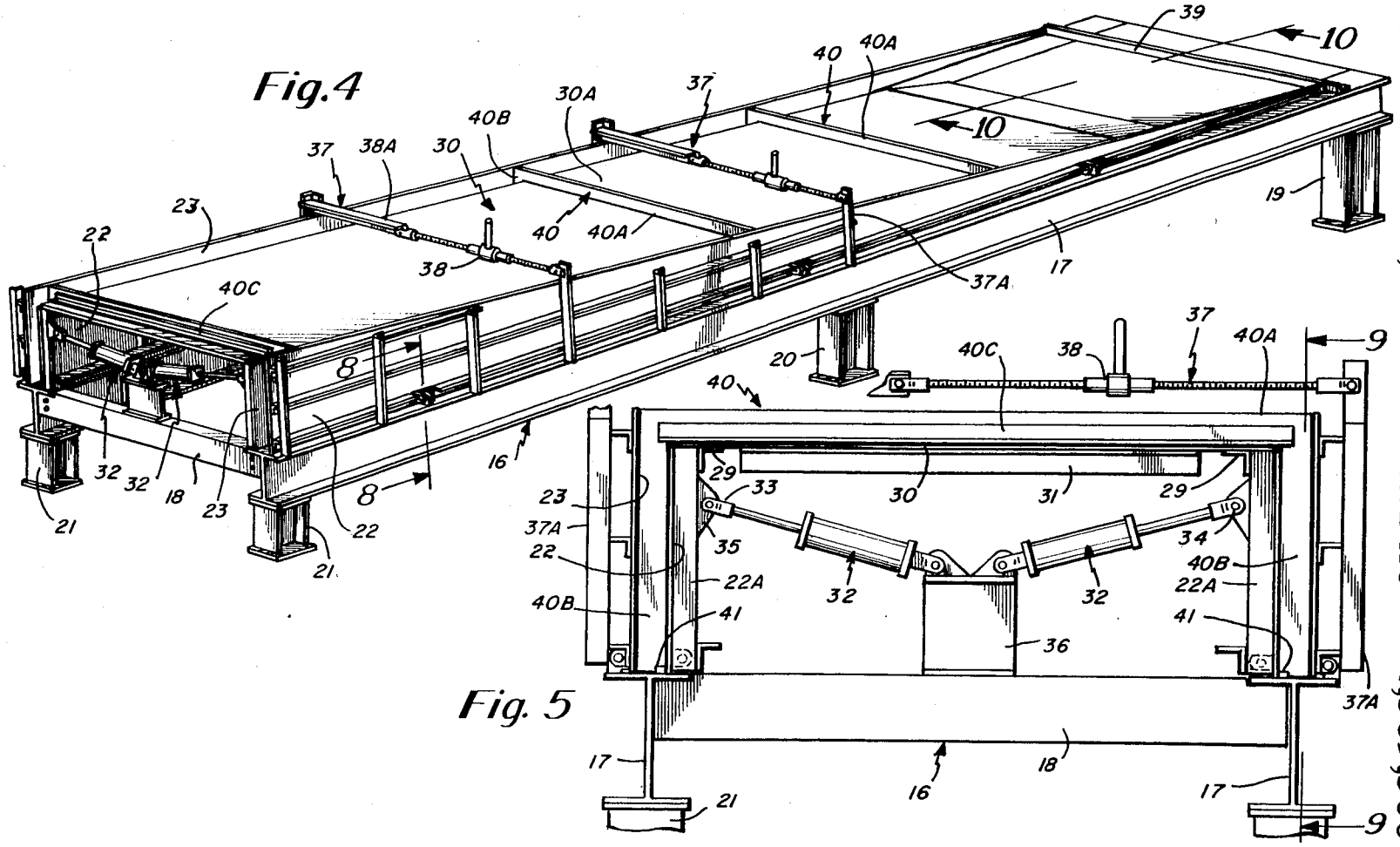
FIG. 4 is a perspective view of the form.
FIG. 5 is a view of the form on an increase in scale, as seen from the rear, high end of its base.
Figure 6:
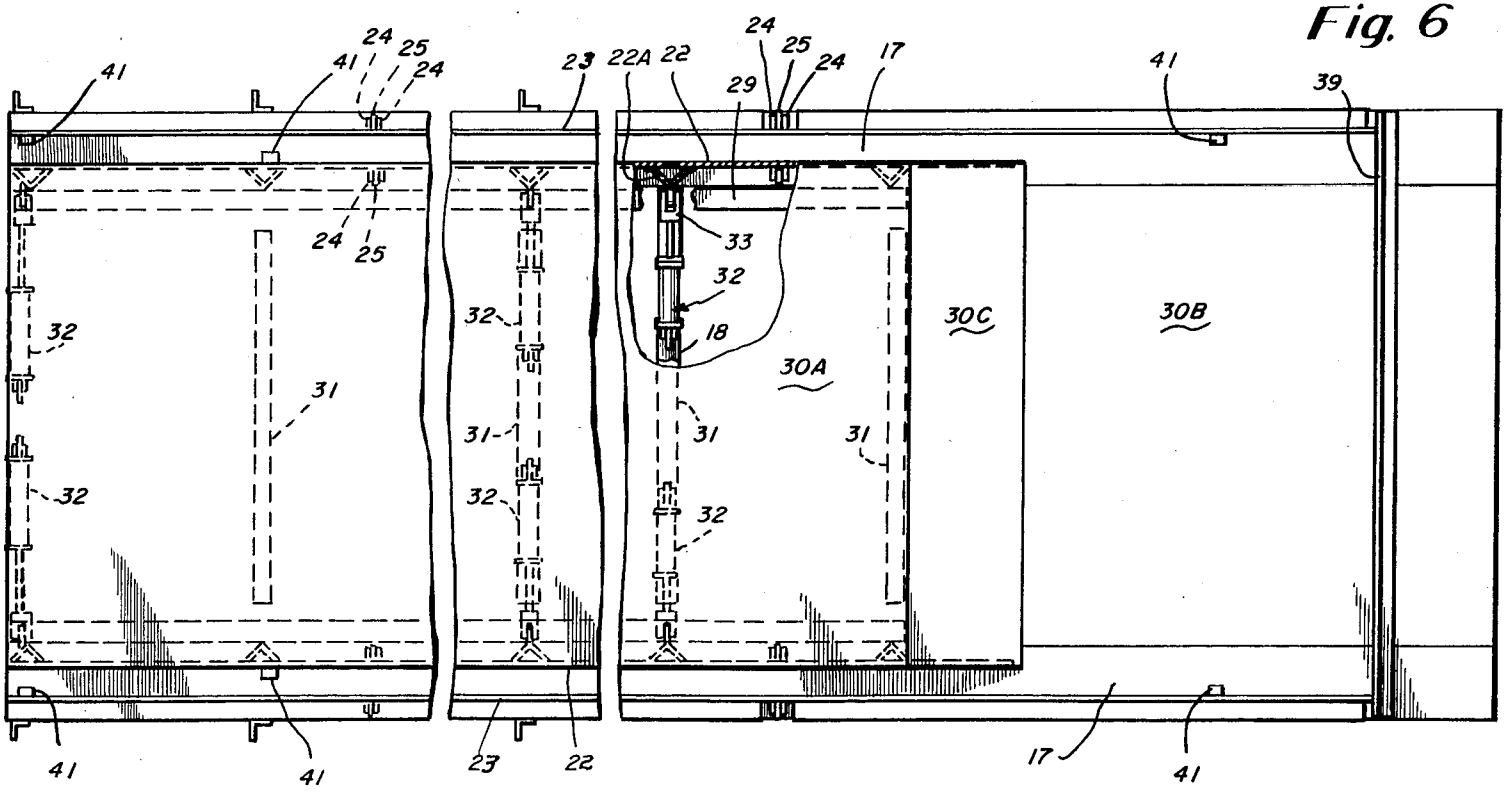
FIG. 6 is a plan view of the form, broken away to foreshorten the drawing.
Figure 7:
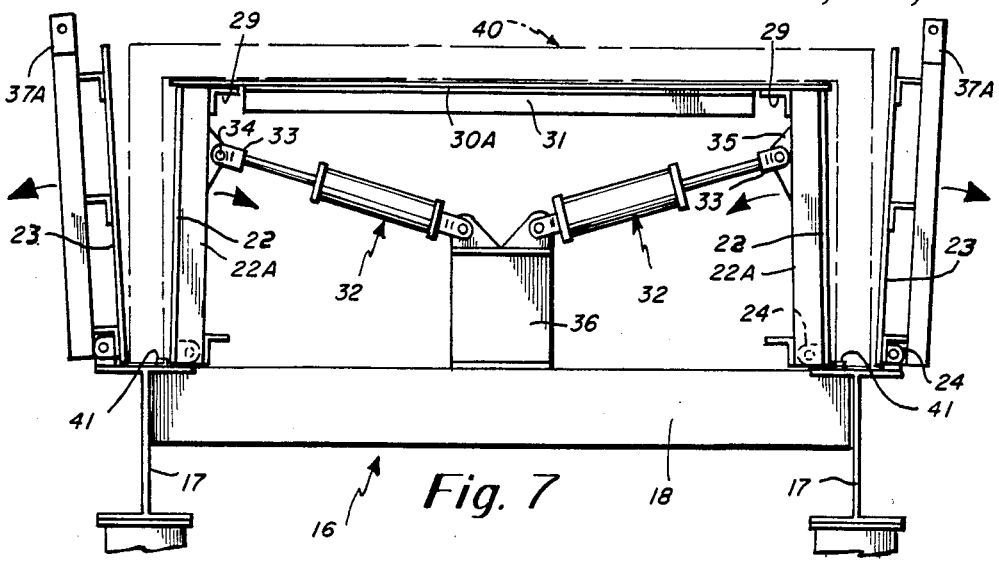
FIG. 7 is a view similar to FIG. 5 with the sides released to enable a completed form to be removed.
Figure 8:
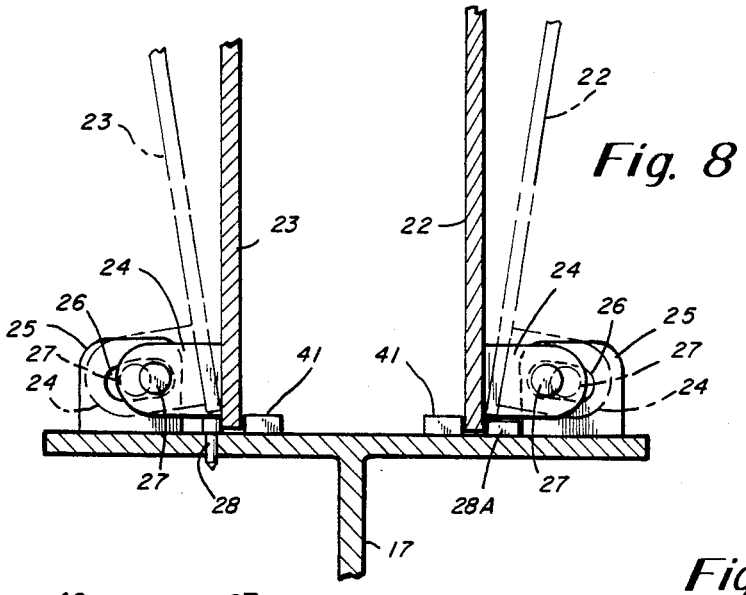
FIG. 8 is a fragmentary view, on a further increase in scale, taken approximately along the indicated line 8—8 of FIG. 4.
Figure 9:
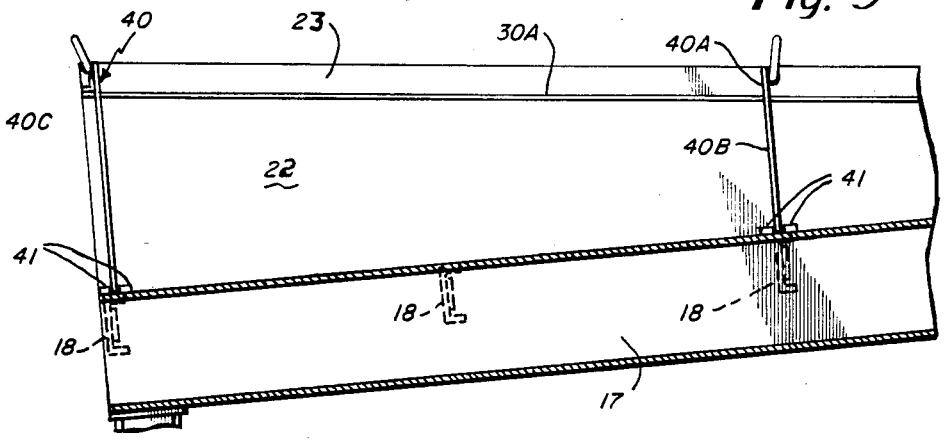
FIG. 9 is a fragmentary lengthwise section of the form taken approximately along the indicated line 9—9 of FIG. 5.

A ramp in accordance with the invention is generally indicated at 10 and shown as installed to enable a wheel chair to travel easily between a lower level and a platform generally indicated at 11, such a platform being often required to enable a wheel chair to pass easily through a door 12.

The ramp 10, see FIGS. 1–3, is shown as consisting of four sections, generally indicated at 10A, 10B, 10C, and lOD, each of reinforced concrete. Each section, in cross section, is in the form of an inverted U thus providing a deck 13 and side walls 14 the bottom edges of which are transversely aigned and in a plane inclined relative to that of the deck 13 to establish the wanted incline of the installed ramp. With reference to FIG. 1, it is assumed that the four sections enable the ramp to be used where the height of the platform 11 relative to the lower level, typically the ground level, is at a maximum. While the sections are shown as of equal lengths, their lengths and the number of sections is determined by the height of the platform and transportaion and loading and unloading limitations imposed by the equipment used.

Except for the front or bottom sections lOA, the ramp sections are open at both ends. The front section lOA includes a transverse portion 15 integral with its deck and side walls with its upper surface in the plane of the deck 13 and its bottom surface in the plane of the bottom edges of the side walls 14. The length of the section 15 is such as to ensure ample reinforcement for the end of the ramp which typically is flush with the level of the lower surface which usually but not necessarily is asphalt coated. In practice, the deck and side walls are three inches thick and the section 13 tapers forwardly to about one and one-quarter inch and its lengthwise extent is such that the rear portion is thicker than the deck, four inches by way of example and not of limitation.

The platform 11 is also of reinforced concrete and in the form of an inverted U but is closed at one end by an end wall 11A with its other end open and either disposed against the building in front of the door 16 or in a position to be closed when the ramp section 1D is butted against it.

The form on which the ramp 10 is cast is illustrated by FIGS. 4–11. The form is supported by a base generally indicated at 16 and is shown as consisting of sides in the form of I-beams 17, interconnected by transverse members 18 and supported by posts 19, 20, and 21 spaced lengthwise of the beams 17 with their height increasing in a manner such that the base 16 is inclined at an angle wanted for the slope of the ramp 10 with the upper end of the base, the front end of the form.

The form includes a pair of spaced apart inner and outer side walls 22 and 23 with each pair hingedly connected at spaced intervals to the upper surface of the appropriate one of the beams 17 to enable the walls to be swung into and out of their erect, form establishing relationship and away from each other to permit the removal of ramp sections. Each wall of both pairs has ears 24 on its outer surface with each pair straddling a lug 25 fixed on the upper surface of the appropriate one of the beams 17 and having a slot 26 through which they are connected by a pin 27. Between each lug 25 and the position occupied by the bottom edge of the proximate wall when erected, there is a stop 28 or 28A engageable by and backing the bottom wall edge to prevent that wall from kicking out due to the pressure of the concrete filling the space between each pair of side walls and the upper surface of the beam to which they are connected.

The upper edges of the side walls are horizontal when erected and those of the inner side walls 22 terminate below the corresponding edges of the side walls 23 by a distance equal to the wanted thickness of the decks 13 of the ramp sections and brackets 29 extend along their inner surfaces. A plate generally indicated at 30 includes a main section 30A supported by the upper edges of the side walls 23 and by the brackets 29 and is provided with a series of transverse reinforcements 31 on its undersurface.

The inner walls 22 of each pair of side walls is under the control of pairs of air operated piston-cylinder units, each unit generally indicated at 32 and with each mounted on an appropriate one of the transverse members 18. Each unit 32 has a fork 33 connected by a pivot pin 34 to a lug 35 secured to a reinforcement 22A on the inner surface of the appropriate one of the inner walls 22.

One pair of units 32 is located near the front end of the base with their cylinders 32B pivotally secured directly to lugs on a transverse member 18 while the other pairs of units 32 have their cylinders 32B pivotally secured to mounts 36 fixed on the appropriate ones of the transverse members 18 with their height increasing towards the rear end of the form in order that pressure attendant their operation will be applied to the upper portions of the side walls 22. The units 32 are conventionally controlled to enable them to be so actuated as to position and securely hold the inner walls in their operative position or to be so actuated as to swing the inner walls inwardly to free them and permit the plate 30 to be released and become supported by the inner walls 22 in their collapsed positions.

While the outer walls 23 may also be moved into and out of their operative, form-establishing positions by like air-operated units mounted on brackets extending outwardly from the beams 17, it is preferred to use transverse clamps, generally indicated at 37, and spaced lengthwise of the form. In practice, the clamps 37 include braces 37A welded to the outer surfaces of the walls 23 which extend above their upper edges and are adjustably connected by a ratchet binder 38 connected, usually detachably, to one such brace and provided with an extension 38A either pivotally or detachably connected to an opposite brace 37A.

Figure 10:
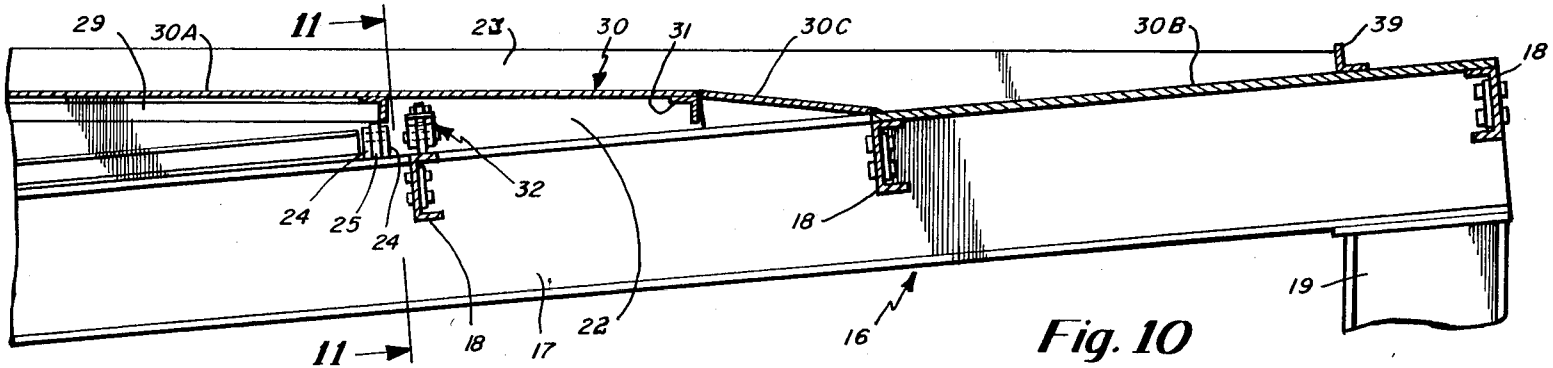
FIG. 10 is a like section taken lengthwise through the front, upper end of the form approximately along the indicated line 10—10 of FIG. 4.
Figure 11:
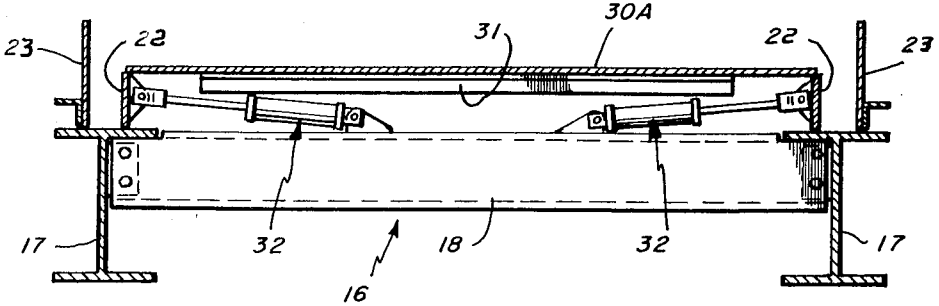
FIG. 11 is a section taken approximately along the indicated lines 11—11 of FIG. 10.

The plate 30 also includes a section 30B supported by transverse members 18 to be flush with the upper surfaces of the I-beams 17, see FIG. 10, and extending to the upper end of the form. The inner walls 22 terminate adjacent the inner end of the section 30B which carries a transverse member 39 butting against the ends of the side walls 23 to close the upper end of the form. The plate 30 also includes a short section 30C downwardly and forwardly inclined from the forward end of the section 30A and connected thereto and to the rear edge of the section 30B.

The ramp 10 is shown as having several sections. By way of example and not of limitation a ramp length of thirty-two feet is not unusual and the form as shown may be considered of a length appropriate for production of ramps of that length. Section lengths of, say eight feet, are readily handled with equipment employed in loading and unloading heavy items at construction sites. To enable the ramp to be formed in sections, cut-off plates generally indicated at 40 are provided. These, see FIGS. 4 and 5, consist of a transverse portion 40A and depending appropriately shaped and dimensioned rectangular end portions 40B. The several cut-off plates 40 differ as to the length of their end portions which is determined by their wanted location lengthwise of the form and the cut-off plate at the rear of the form, and any cut-off plate that is to be an end of a section not backed by another section, has a transverse reinforcement 40C to prevent bowing of the cut-off plate under the pressure of the cement. In this connection, it should be noted that a ramp is needed between two elevated platforms of different heights thus not requiring an end section such as section 10A. Each cut-off plate 40 is held in position by stops 41 welded to the upper surfaces of the beams 17 and each cut-off plate serves to ensure that the walls are perpendicular when erected.

I claim:

1. A form for use in forming a concrete ramp having a main portion in the form of an inverted U the central portion of which is the tread surface and a short, front, lower end portion integral with the main portion and having a tread surface merging with the tread surface thereof, the lower surface of the end portion and the bottom edges of the main portion in the same plane, said form including a base of a desired length and width and provided with flat supporting surfaces that are the bottom of the form, structure supporting said base inclined at the angle desired for the slope of the tread surface of said main portion when said structure is resting on a substantially horizontal surface, the high end of said base supporting the front of the form, pairs of inner and outer side walls, the front ends of the inner walls and the upper edges thereof terminating short of the ends and upper edges respectively of the outer walls, means hingedly connecting the lower margins of each pair of walls to a supporting surface of the base in a spaced apart relationship desired for the width of the ramp and with the walls of each pair spaced apart a distance desired for the thickness of the side walls of the ramp, said connecting means enabling the walls of each pair to be swung away from each other, adjustable means extending across the form and above the upper edges of the outer walls and detachably connected thereto and operable to hold said outer walls in their erect, operative positions, a plate that is the bottom of the form with respect to portions of the ramp between said inner walls, said plate including a main portion freely supported by said inner walls with the plane of the plate in the plane of the upper edges thereof, said plate also including a front portion downwardly inclined towards the front end of the form, and a fixed base portion in the front end in the plane of the supporting surface of the base the rear portion of which supports the front edge of the front portion of the plate and which includes a transverse member closing the front of the form, power operated means on said base between said pairs of walls and operable to effect movement thereof outwardly into form establishing positions and inwardly into an inoperative position with said plate freely supported by said inner walls during such movements and moved into the operative position thereof when said inner walls are operatively positioned, a squared U-shaped cut-off to close the rear end of the form and means connecting said cut-off to the form against movement as the form is filled with concrete.

2. The form of claim 1 in which the cut-off and the transverse member are stops against which the inner and outer walls are held by the connecting means and by the power operated means.

3. The form of claim 1 in which there are a series of connecting means spaced lengthwise of the form and each includes a tensioning section.

4. The form of claim 1 in which there are a plurality of cut-offs, each dimensioned and located lengthwise of the form to enable the ramp to be formed in sections.

5. The form of claim 4 in which the cut-offs are so located that the ramp sections are of equal length.

6. The form of claim 4 in which stops are tack-welded to said surface in wanted cut-off locations by which the cut-offs are held against lengthwise movement.

7. The form of claim 1 in which the proximate faces of the inner walls include plate supporting shoulders.

* * * * *